US005608365A

United States Patent [19]

Marquardt et al.

[11] Patent Number: 5,608,365

[45] Date of Patent: Mar. 4, 1997

[54] MULTI-POLE LOW-VOLTAGE POWER SWITCH WITH A SWITCHING SHAFT

[75] Inventors: Ulrich Marquardt; Ludvik Godesa, both of Berlin, Germany

[73] Assignee: Siemens Aktiengesellschaft, München, Germany

[21] Appl. No.: 307,857

[22] PCT Filed: Mar. 12, 1993

[86] PCT No.: PCT/DE93/00241

§ 371 Date: Oct. 31, 1994

§ 102(e) Date: Oct. 31, 1994

[87] PCT Pub. No.: WO93/20576

PCT Pub. Date: Oct. 14, 1993

[30] Foreign Application Priority Data

Apr. 1, 1992 [DE] Germany ..... 42 11 429.2

[51] Int. Cl.[6] ..... H01H 75/00

[52] U.S. Cl. ..... 335/8; 335/167

[58] Field of Search ..... 335/8–10, 23, 335/24, 25, 167–76

[56] References Cited

U.S. PATENT DOCUMENTS

| | | | |
|---|---|---|---|
| 3,786,380 | 1/1974 | Harper | 335/9 |
| 4,347,488 | 8/1982 | Mune et al. | 335/9 |
| 5,157,366 | 10/1992 | Mullins et al. | 335/8 |
| 5,287,077 | 2/1994 | Arnold et al. | 335/8 |

FOREIGN PATENT DOCUMENTS

| | | |
|---|---|---|
| 0094858 | 11/1983 | European Pat. Off. . |
| 0208613 | 1/1987 | European Pat. Off. . |
| 0320412 | 6/1989 | European Pat. Off. . |
| 1527535 | 5/1968 | France . |
| 2855205 | 7/1980 | Germany . |
| 3542746 | 6/1987 | Germany . |
| 0623640 | 6/1981 | Switzerland . |
| 1061279 | 3/1967 | United Kingdom . |

*Primary Examiner*—Lincoln Donovan
*Attorney, Agent, or Firm*—Kenyon & Kenyon

[57] ABSTRACT

A multi-pole low-voltage power switch designed with several switching chambers per pole and a common switching shaft which acts for the pole units is formed by the switching chambers. The switching shaft is made up of shaft sections which correspond to the pole units. While the central shaft section has central pins and levers, the peripheral shaft sections are fitted with levers and have central apertures in which the pins engage. Bolts which pass through the levers are used to couple the shaft sections together. The pole units rest on a support which is dimensioned to accommodate the maximum width of the pole units and to allow for possible variations in their dimensions. Side walls of the correct dimensions for a pull-out rack enclosed the supporting framework of the power switch on each side.

5 Claims, 3 Drawing Sheets

MULTI-POLE LOW-VOLTAGE POWER SWITCH WITH A SWITCHING SHAFT

BACKGROUND OF THE INVENTION

The present invention relates to a multi-pole low-voltage power switch with a switching shaft shared by all poles, with pole units each assembled from at least two switching chambers, and with a drive apparatus shared by all pole units.

A power switch of this kind is known, for example, from German Patent Document No. DE-A-35 42 746. The construction of power switches evident from this and from other patent documents is theoretically usable for power switches with any rated current. It is known how to construct this kind of power switch for a very high rated currents, which can exceed 4000 A by combining subassemblies that are dimensioned for a low rated current. This applies in particular to the actual current-carrying parts, such as contact systems and arc quenching chambers. A power switch constructed in this fashion is described in European Patent Document No. EP-A-0 320 412.

One feature of the power switch that has been expanded in a modular fashion to a high rated current is its significantly enlarged width, in certain circumstances, as compared to versions for lower rated currents. This entails the problem that normal and otherwise inconsequential dimensional deviations in the assembled components are added together, which can impair the operation of the power switch or even interfere with its proper assembly. The underlying objective of the present invention is to eliminate difficulties which occur because of dimensional deviations, both when the components of the switch are assembled, and as the switch interacts with a pull-out rack.

SUMMARY OF THE INVENTION

The present invention achieves this objective by dividing the switching shaft into shaft sections corresponding to the number of pole units. The shaft section of the center pole unit possesses at both ends a central pin and a lever, mounted close to the pin, with a through hole to receive a coupling bolt. Further, the peripheral shaft sections adjoining the central shaft section possess, at their end facing the central shaft section, a central aperture provided to receive the central pin and also, close to the central aperture, a lever with a through hole to receive the coupling bolt.

Thus, the switching shaft, an important component for the operation of the power switch, is not only easier to manufacture, but because of the subdivision is largely insensitive both to dimensional deviations in the lengthwise direction and to errors in the mutual alignment of the pole units.

Another problem of known switches is that the total width of the power switch can deviate considerably from a nominal value. The present invention eliminates this problem by providing a support for the framework of the power switch that is sized for the total width of all pole units, including a maximum oversize resulting from tolerances. The present invention further provides side walls that are applied at both lateral ends of the support. These innovations provide for a smooth interaction between the power switch and the pull-out rack.

Thus, regardless of the sum of the individual dimensions of its components, the width of the power switch is only affected by the tolerance of one part, namely the support.

The power switch can acquire properties that are also advantageous for use as a pull-out power switch because a displacement shaft is arranged in the power switch, extending transverse to its displacement direction and projecting laterally beyond the side walls, and is provided with gated levers. Further, the displacement shaft is mounted in the pole units and passes through apertures in the side walls with clearance. As a result, that actuation forces are transferred symmetrically to the power switch and act substantially where the force requirement exists, specifically at the breaker contacts of the pole units.

The present invention achieves a particularly tight-fitting coupling of the shaft sections that simultaneously ensures the desired compensation for alignment errors by providing at least one further lever for each shaft section, and coupling bolts that each pass through at least one of the additional levers of the peripheral shaft sections. Thus, the coupling bolts connect to insulating links that transfer the movement of the switching shaft to the contact arrangements of the pole units of the power switch.

The strength and tight fit of the present invention is further enhanced by a partition wall that is arranged between the pole units in the support structure. The partition wall includes a bearing bushing for the central pin of the central shaft section and a curved aperture for the passage of the coupling bolt that is adapted to the pivot angle of the switching shaft during switching.

BRIEF DESCRIPTION OF THE DRAWINGS

The invention will be explained in more detail below with reference to the exemplary embodiment depicted in the Figures.

DETAILED DESCRIPTION

Figure 1:
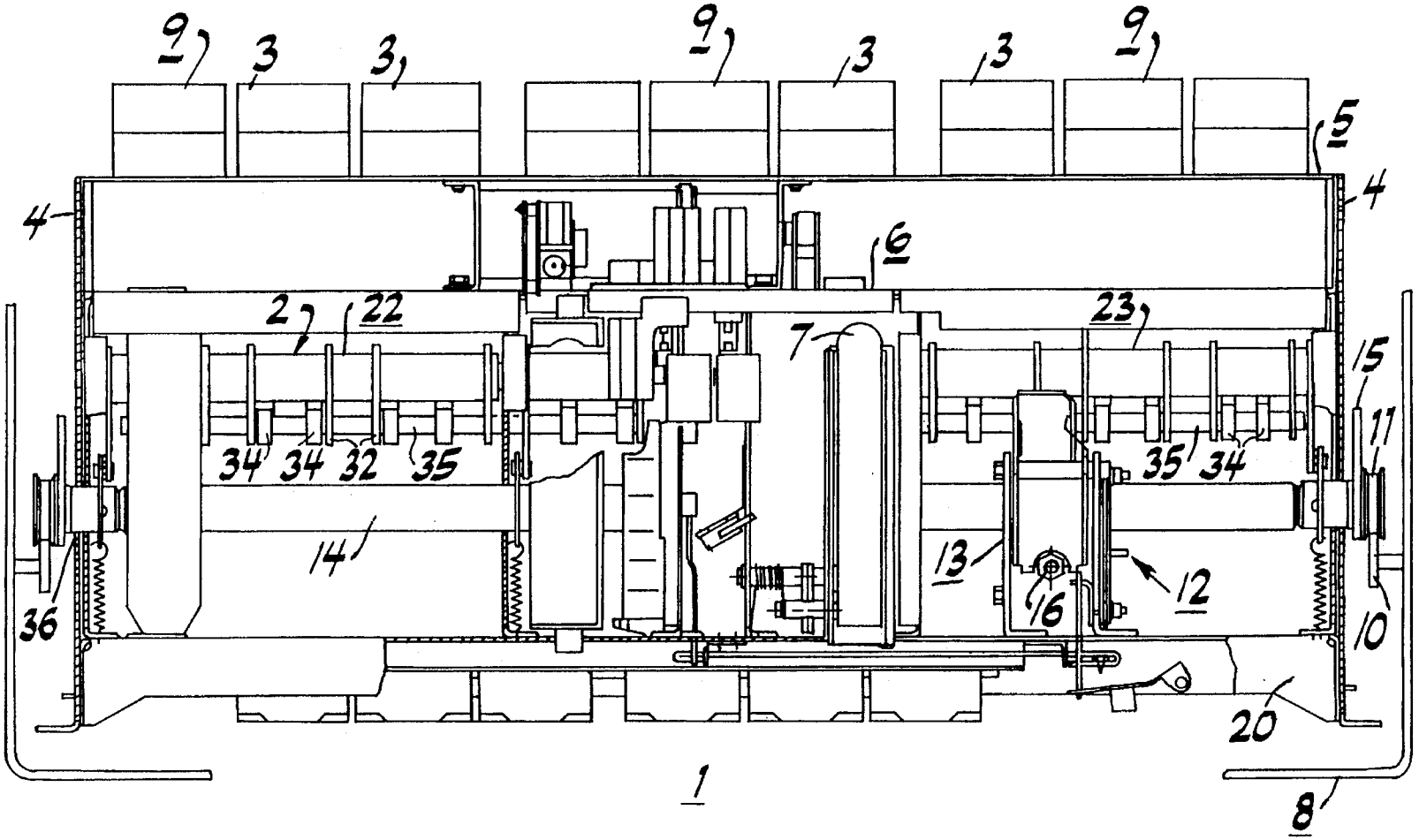
FIG. 1 shows a three-pole low-voltage power switch in a front view, with the control panel removed.

The power switch 1 shown in FIG. 1 comprises a switching shaft 2 that is common to all pole units 9 composed of switching chambers 3, and extends accordingly over the entire width of power switch 1. Pole units 9 are received in a supporting framework 5, provided with side walls 4, together with a drive apparatus 6 that has an actuation handle to tension a spring-loading device. In addition, the spring-loading device can be tensioned by a motor, as is known in the art. Pull-out rack 8 bears on its inner side displacement rails 10 for displacement rollers 11 applied laterally onto power switch 1. A displacement apparatus 12, mounted alongside drive apparatus 6 in supporting framework 5, has a bearing bracket 13 and a displacement shaft 14, also extending over the entire width of power switch 1, onto each of whose ends projecting beyond the side walls is attached a gated lever 15 that interacts with a bolt which is covered by displacement rollers 11 and acts as the stationary buttress. To rotate displacement shaft 14, the bearing bracket contains a threaded spindle 16, one of whose ends is accessible for operation at the front of power switch 1.

A supporting framework 5 has a support 20 that can be configured in a single or multiple parts and that extends over the entire width of the power switch 1. The support 20 is dimensioned so that it corresponds to the sum of the width of the pole units 9, including a required mutual spacing and the greatest potential oversize that the aforementioned arrangement can exhibit due to tolerances. The outer lateral termination of the supporting framework 5 is comprised of the aforesaid side walls 4, which under normal circumstances are at a certain distance from the outer pole units 9. As a result of this configuration, the power switch 1 possesses a width which is independent of dimensional deviations of the switching chambers and of pole units 9 composed thereof, and is determined only by supporting framework 5. This ensures, in particular, that the displacement rails 10 and the displacement rollers 11 can reliably interact.

Figure 2:
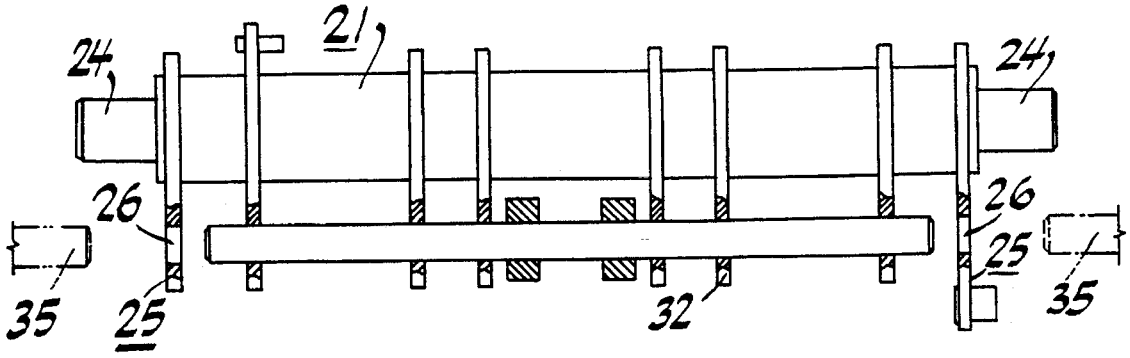
FIGS. 2, 3, and 4 show a central shaft section as well as two peripheral shaft sections adjoining the central shaft section, as individual parts.
Figure 3:
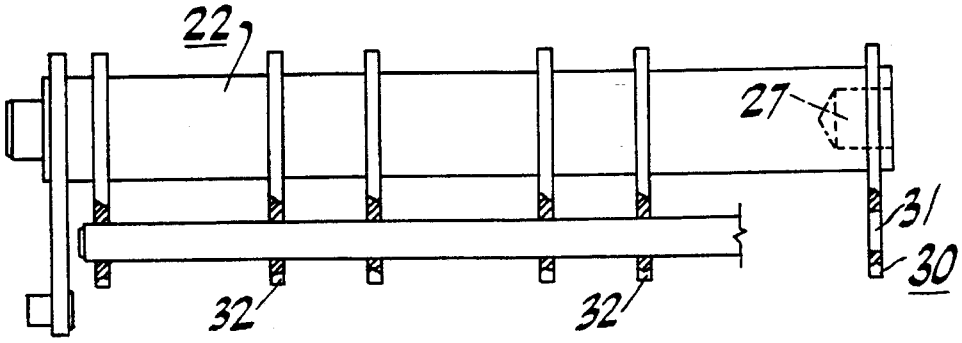
Figure 4:
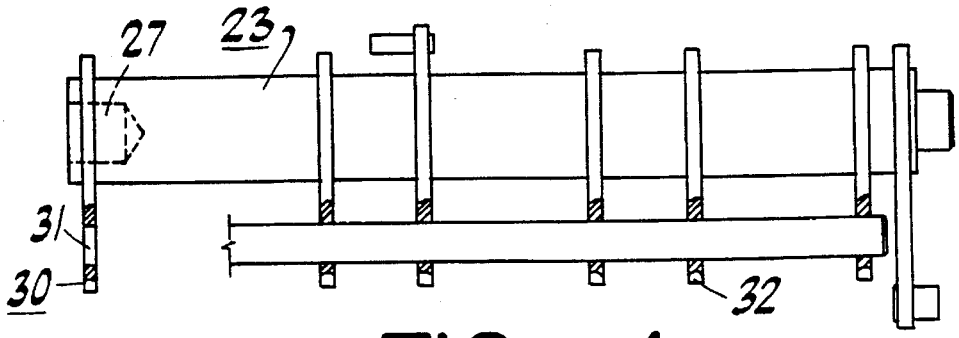

The switching shaft 2 is composed of three shaft sections 21, 22, and 23, the configuration of which is evident in more detail in FIGS. 2, 3, and 4.

Shaft section 21 is configured as the central part, which can be coupled to the left shaft section 22 and the right shaft section 23. For this purpose, shaft section 21 possesses on each end a central pin 24 and, near the pin, a lever 25 that has a through hole 26 for a coupling bolt 35.

The left shaft section 22 and right shaft section 23 are configured as mirror images, and each has at its end facing the central shaft section 21 a central opening 27 and, near this opening, a lever 30 with a through hole 31 for a coupling bolt 35. The left and right shaft sections are visible in FIG. 1, while the central shaft section 21 is concealed by the drive apparatus 6 placed in front of it.

In order to connect with contact systems of the switching chambers 3, all the shaft sections 21, 22, and 23 described above are provided with further levers 32 through which coupling bolts 35 extend (FIG. 1). In a known manner, coupling bolts 35 comprise insulating links 34, by means of which the contact arrangements in the pole units 9 can be actuated.

The configuration of switching shaft 2 and supporting framework 5 described above permits the straight forward assembly of power switch 1 from its essential subassemblies. The drive apparatus 6, the pole units 9, and the supporting framework 5 can be prepared as prefabricated modules. The pole units 9 contain the shaft sections 21, 22, and 23, which are then roughly aligned with one another by simple insertion. The aforesaid coupling bolts 35 are then introduced into the levers 25 and 30. The power switch 1 is terminated externally along its width by the aforesaid side walls 4, which are at a certain distance from the side walls of the outer pole units 9.

Figure 7:
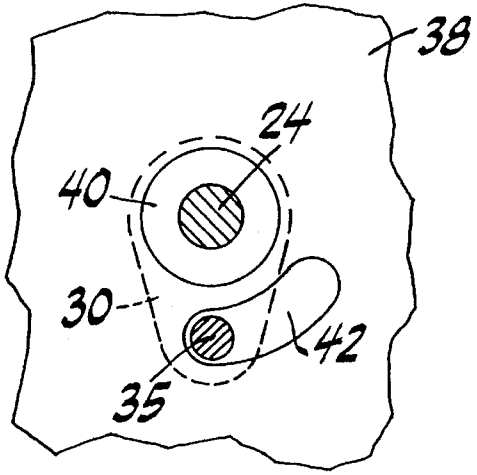
FIG. 7 depicts a detail of a partition wall arranged between two pole units of the power switch.

Coupling of the shaft sections and mounting thereof is visible in more detail in FIGS. 5, 6, and 7, which will be explained below.

Figure 5:
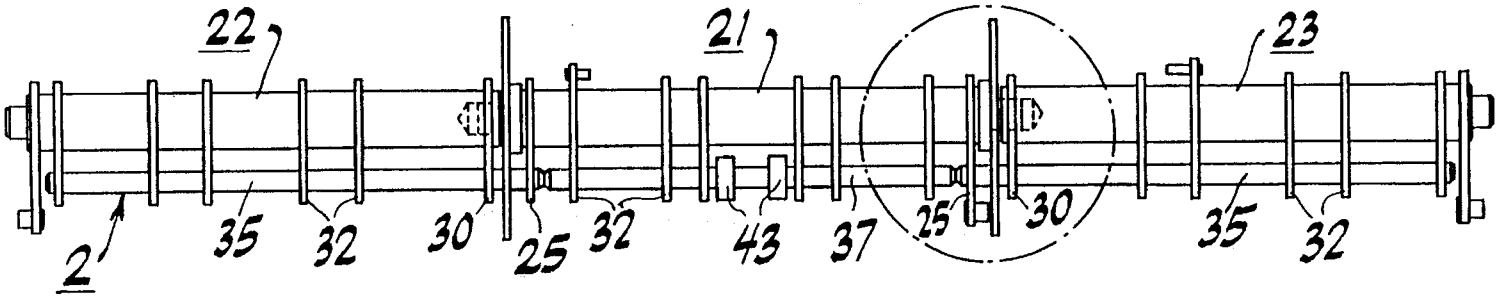
FIG. 5 shows a switching shaft composed of shaft sections according to FIGS. 2, 3, and 4, with levers and coupling bolts sitting thereon.

FIG. 5 shows only the three previously described aligned shaft sections 21, 22, and 23 with levers 32 sitting thereon. As is evident, the coupling bolts 35 are longer than the associated shaft sections 22 and 23, so that the coupling bolts 35 pass through all of the levers 30 and 32 sitting on shaft sections 22 and 23, and additionally through lever 25 of the adjacent central shaft section 21.

Extending through the remaining lever 32 of the central shaft section 21 is a shorter bolt 37 which creates the connection to insulating links 34 of the central pole unit 9. Because coupling bolts 35 pass through a plurality of levers, their play with respect to those levers, and accordingly the play of the entire coupling, is very small. Alignment errors of shaft sections 21, 22, and 23 are nevertheless accommodated, since only one or two levers are comprised in the respective adjacent shaft section. It is significant with regard to reliable transfer of high torque that the couplings act over a radius with respect to the shaft axis defined by levers 25, 30, and 32.

The shaft arrangement is mounted not only at the ends but also in the region of the coupling points. Details are evident from FIG. 6, which shows at enlarged scale the section marked in FIG. 5 with a dot-dash circle. As is evident, shaft sections 21 and 23 pass through a partition wall 38 in supporting framework 5 of power switch 1. Located on the central pin 24 of the central shaft section 21 is a bearing bushing 40 that can be of undivided design. Because of the relatively short axial length of the bearing bushing 40, which is supported in partition wall 40 by means of a step 41, this arrangement can also accommodate small deviations in the alignment of shaft sections 21 and 23. This ensures that despite their long axial length and the need to transfer high torque, the three shaft sections can be actuated smoothly and without jamming.

Figure 6:
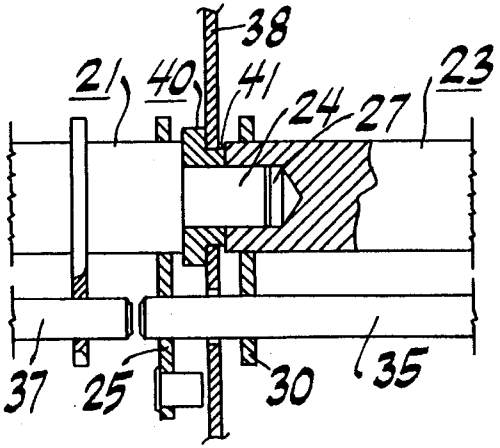
FIG. 6 shows a detail in the region of the connection between two shaft sections.

In the arrangement according to FIGS. 5 and 6, coupling bolts 35 pass through partition wall 38. At this point, partition wall 38 according to FIG. 7 is provided with a curved aperture 42 that, in accordance with the limited pivot angle of the shaft arrangement, covers only about 60 degrees during switching.

Also shown in FIG. 5 are drive levers 43 which transfer drive force from the drive apparatus 6 (FIG. 1) to the switching shaft 2.

For the proper interaction of the power switch 1 with the slide-out rack 8, it is important that the breaker contacts, provided in a known manner, be brought reliably into engagement. This is achieved whereby displacement shaft 14 is mounted in the pole units 9, and passes through apertures in the side walls with clearance. In this manner, the forces are transferred not via the supporting framework 5, but directly, since the movable elements of the breaker contacts are located on the pole units. In the region of the left side wall 4, FIG. 1 shows a passthrough opening 36 that is enlarged with respect to the diameter of displacement shaft 14.

What is claimed is:

1. A multi-pole low-voltage power switch comprising:

a switching shaft shared by all poles, including pole units each assembled from at least two switching chambers, wherein the switching shaft is divided into shaft sections corresponding to a number of the pole units;

a drive apparatus shared by all the pole units;

a central pin protruding from both ends of a shaft section of a center pole unit of said pole units;

a lever mounted substantially near the pin at each end of the shaft section, the lever including a through hole to receive a coupling bolt;

peripheral shaft sections adjoining the central shaft section which include a central aperture at ends facing the central shaft section provided to receive the central pin; and a lever with a through hole to receive the coupling bolt close to the central aperture.

2. The power switch according to claim 1, including a supporting framework of the power switch that has a support that is dimensioned for the total width of all pole units, including a maximum oversize resulting from tolerances and side walls that are applied at both lateral ends of the support.

3. A power switch according to claim 2, capable of displacement inside the pull-out rack comprising a displacement shaft that is arranged in the power switch, extending traverse to its displacement direction and projecting laterally beyond the side walls, and provided with gated levers such that displacement shaft is mounted in the pole units and passes through apertures in the side walls with clearance.

4. The power switch according to claim 1, wherein the shaft sections each possess at least one further lever and the coupling bolts each pass through at least one of the additional levers of the peripheral shaft section.

5. The power switch according to claim 2, including a partition wall that is arranged between each of the pole units in a support structure, each partition wall including a bearing bushing for the central pin of the central shaft section and a curved aperture for the passage of the coupling bolt adapted to the pivot angle of the switching shaft during switching.

* * * * *